US005458216A

United States Patent [19]

Tanaka et al.

[11] Patent Number: 5,458,216

[45] Date of Patent: Oct. 17, 1995

[54] ELEVATOR APPARATUS

[75] Inventors: Masakatsu Tanaka; Seinosuke Yahiro; Jun Sugahara, all of Katsuta; Satoru Sasaki, Mito, all of Japan

[73] Assignees: Hitachi, Ltd.; Hitachi Building Systems Engineering & Services Co., Ltd., both of Tokyo, Japan

[21] Appl. No.: 121,568

[22] Filed: Sep. 16, 1993

[30] Foreign Application Priority Data

Sep. 17, 1992 [JP] Japan ..... 4-247546

[51] Int. Cl.[6] ..... B66B 5/16

[52] U.S. Cl. ..... 187/373; 187/394

[58] Field of Search ..... 187/89, 90, 91, 187/108, 288, 373, 374, 394; 188/188, 189

[56] References Cited

U.S. PATENT DOCUMENTS 4,440,024 4/1984 Caputo et al. ..... 73/529

4,628,200 12/1986 Tinios ..... 250/231 SE

FOREIGN PATENT DOCUMENTS 372575 6/1970 European Pat. Off. .

0372575A2 6/1990 European Pat. Off. .

3177283 1/1991 Japan .

*Primary Examiner*—Kenneth Noland

*Attorney, Agent, or Firm*—Antonelli, Terry, Stout & Kraus

[57] ABSTRACT

An elevator apparatus having an easily mountable position detector and capable of detecting the position of a car with good precision. The apparatus has a position detector and a governor driven by a cable connected to an emergency stop device mounted on a car and capable of actuating the emergency stop device when the speed of the car has exceeded a prescribed speed, the position detector being driven by the governor, the apparatus includes a power transmission mechanism for causing rotation of the position detector at a speed higher than the speed of rotation of the governor.

31 Claims, 10 Drawing Sheets

ELEVATOR APPARATUS

BACKGROUND OF THE INVENTION

1. Field of the Invention

The present invention relates to an elevator apparatus, and particularly, to an elevator apparatus having a detector for detecting the position of a car.

2. Description of the Related Art

One form of art for detecting the position of an elevator car is disclosed in U.S. Pat. No. 5,052,522. In this art, a roller is kept in contact with a rotary portion, such as an idler sheave, of an elevator hoist constituting a part of the drive system, so as to drive a position detector.

In another form, a position detector is driven by utilizing the rotation of a governor (Japanese Patent Unexamined Publication No. 3-177283).

In the former art, since the idler sheave is driven by the main rope by which the car is suspended, wire-lubricating oil contained in the main rope may bleed to the surface of the idler sheave on which the roller of the position detector rolls, and thus cause adhesion of dust to the sheave surface. As a result, the roller may slip on the sheave surface, or may have to run on dust adhered to and deposited on the sheave surface, thereby making it impossible to effect accurate detection of position. In order to avoid this problem, an arrangement is disclosed, for example, in Japanese Patent Unexamined Publication No. 62-27283, in which the roller of the position detector rolls on the outer peripheral surface of a brake drum which surface is free from influence by lubricating oil on the rope. With this arrangement, however, since the brake drum is provided in the drive system, accurate position-detection is impossible when there is slip between the drive system and the main rope. Actually, therefore, the adoption of the arrangement is combined with the use of another position detector.

In the latter art, the rotary shaft of the position detector is directly connected mechanically with the rotary shaft of the governor. It is difficult to effect connection in such a manner as to achieve alignment between the axis of rotation of the position detector, which is a precision instrument, and the axis of rotation of the governor. As a result, when there is a deviation in the axis of rotation, it is difficult to effect precise position-detection. Another drawback is that no consideration is given to an arrangement for increasing the number of pulses generated for position detection so that it is not readily possible to effect accurate position-detection.

SUMMARY OF THE INVENTION

An object of the present invention is to provide an elevator apparatus capable of accurately detecting the position of a car.

Another object of the present invention is to provide an elevator apparatus having a position detector which can be easily incorporated.

Still another object of the present invention is to provide an elevator apparatus capable of increasing the level of precision of position detection.

A further object of the present invention is to provide an elevator apparatus capable of accurately detecting a position even with regard to a car moving vertically at a relatively high speed.

The above objects are achieved by providing an elevator apparatus having: a governor driven by a cable connected to an emergency stop device mounted on a car, and capable of actuating the emergency stop device when the speed of the car has exceeded a prescribed speed; and a position detector driven by the governor, the apparatus including a power transmission mechanism for increasing the speed of rotation of the governor and transmitting rotation at a higher speed to the position detector. The power transmission mechanism may employ an endless member.

With the above construction, it is possible to increase the number of revolutions per unit time in the position detector. Since the number of pulses generated is accordingly increased, it is possible for the detection of the position of the car, which is performed by counting pulses, to be stable and have increased precision. The position detector is mounted through the power transmission means, and thus, it is possible to simply incorporate the position detector. When a power transmission mechanism employs an endless member, the contact surfaces for transmitting power have an increased area, thereby making it possible to transmit power without involving slip even during high-speed movement, and hence, possible to effect accurate position-detection.

DESCRIPTION OF THE PREFERRED EMBODIMENTS

Figure 1:
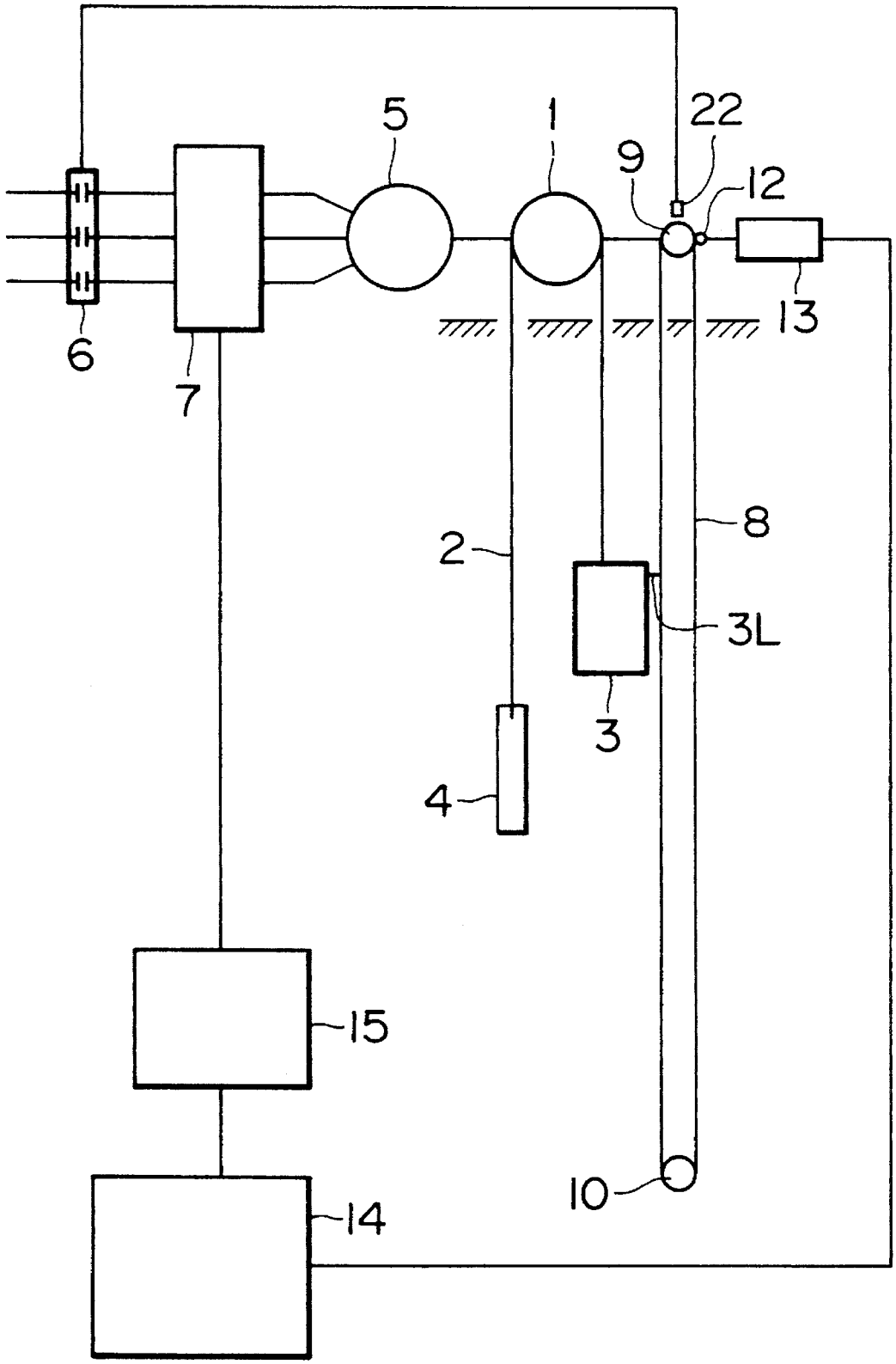
FIG. 1 is a view schematically showing an embodiment of an elevator apparatus according to the present invention.

An embodiment of the present invention will now be described with reference to FIGS. 1 to 4. Referring mainly to FIG. 1, an elevator apparatus according to the embodiment has a drive sheave 1 of a hoist provided in a machine house at an uppermost location of the elevator shaft, and a main rope 2 wound on the drive sheave 1. An elevator car 3 is fastened to one end of the main rope 2, and a counterweight 4 is fastened to the other end in a manner exactly like that of a pair of roped well-buckets. When the drive sheave 1 rotates, the main rope 2 is moved, causing the car 3 to ascend or descend along guide rails (not shown), so as to provide a vertical transportation means which allows passengers to move between floors.

The drive sheave 1 is connected to an induction motor 5 either directly or through a reduction gear (not shown) so as to be driven by the motor 5. The induction motor 5 is supplied with variable-voltage variable-frequency three-phase alternating current from a three-phase alternating current power source (not shown) through a switch 6 and a power inverter 7.

The car 3 is equipped with an emergency stop device (not shown) having a wedge capable of being inserted into the gap between the car 3 and the guide rails in emergency for forcibly stopping the car 3. Normally, the wedge of the emergency stop device is held by a wedge holder in a state of non-contacting the guide rails. The holder is linked with an operating lever 3L through a link mechanism or the like, and the lever 3L is connected with an endless governor rope 8. The governor rope 8 has an intermediate portion extending in the same direction as the main rope 2 constituting a part of the drive system of the elevator apparatus, an upper curved portion wound on a governor pulley 9 of a governor provided in the machine house, and a lower curved portion wound on a tension pulley 10 disposed at a bottom location of the elevator shaft.

Figure 2:
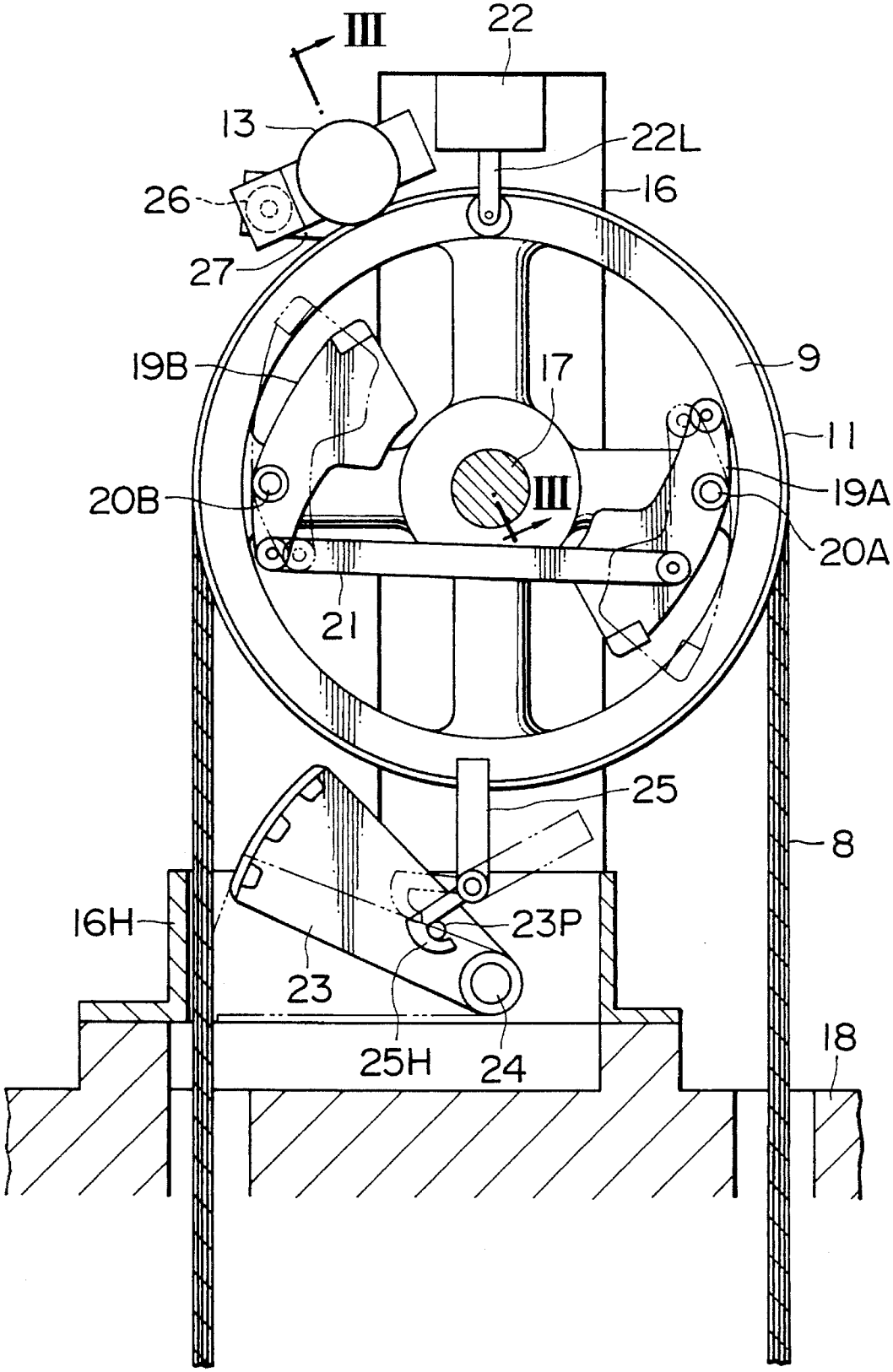
FIG. 2 is a side view schematically showing a governor of the elevator apparatus shown in FIG. 1.
Figure 3:
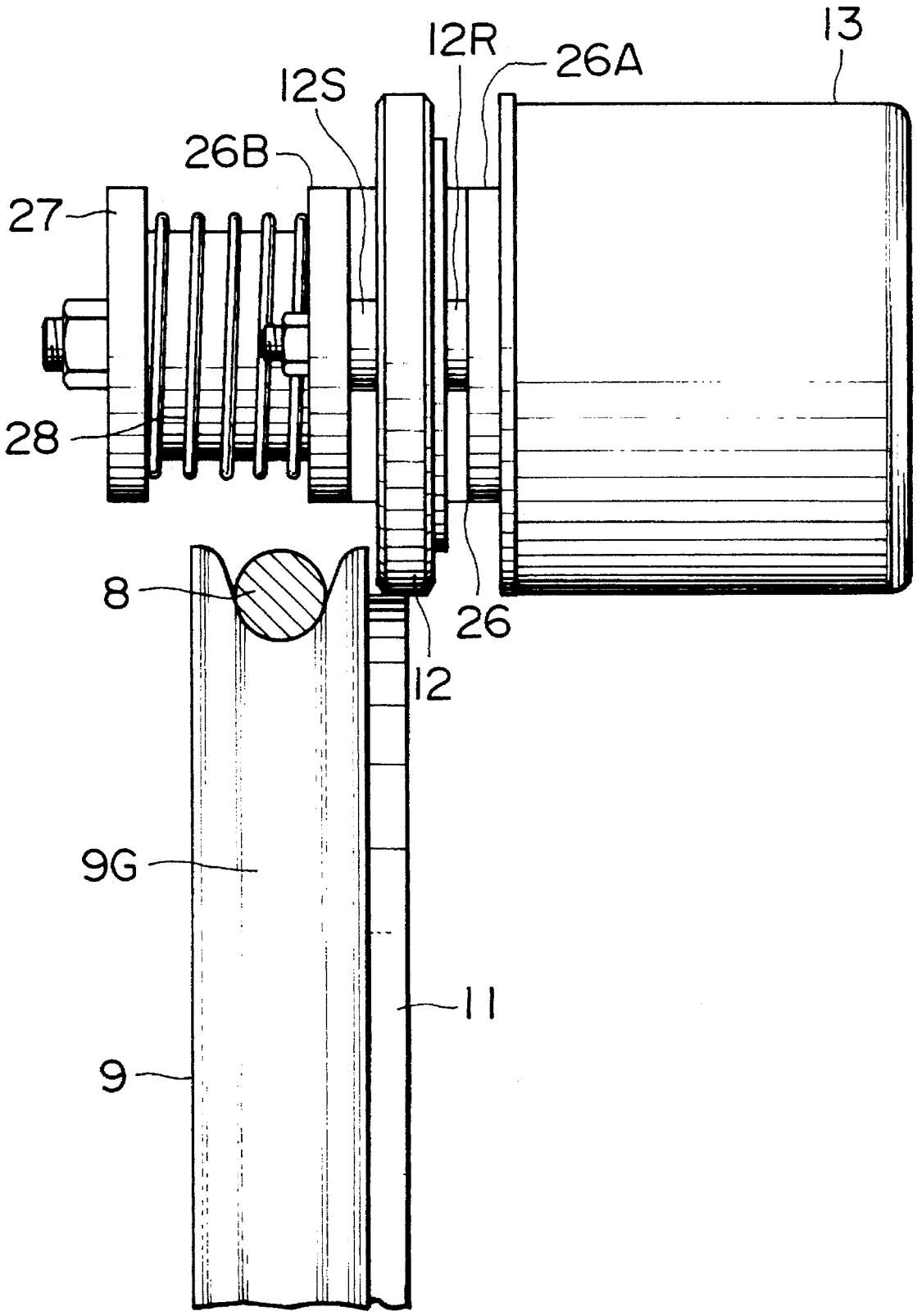
FIG. 3 is an enlarged sectional view of the governor shown in FIG. 2, taken along line III—III shown in FIG. 2.

As shown in FIGS. 2 and 3, the governor pulley 9 has a rope groove 9G on which the governor rope 8 is wound, and a roller rolling surface 11. The groove 9G and the surface 11 are formed on the governor pulley 9 in such a manner as to be adjacent to and concentric with each other. As shown in FIG. 3, a roller 12 is disposed contacting the roller rolling surface 11 for driving a position detector 13. The position detector 13 is capable of generating a number of pulses proportional to the amount of vertical movement of the car 3 so that a signal indicating the count of such pulses can be used as a position signal. The roller rolling surface 11 has a radius extending outwardly to a point coinciding with the axis of the governor rope 8 wound in the rope groove 9G. The roller 12 has a diameter smaller than the diameter of the roller rolling surface 11 formed on the governor pulley 9 so that the roller 12 is able to transmit, to the position detector, an indication of the rotation of the governor pulley 9, but at a higher speed.

Referring to FIG. 1, a position signal from the position detector 13 is input to a control unit 14, which gives a control command accordingly to a power inverter controller 15. When the power inverter controller 15 has received the control command, the controller 15 controls the voltage and/or frequency at the power inverter 7, so as to suitably control the rotation of the induction motor 5.

Referring to FIG. 2, the governor pulley 9 of the governor is supported by a frame unit 16 in such a manner as to be rotatable about a supporting shaft 17, the frame unit 16 being secured to, for example, a floor 18 of the machine house. On one side of the governor pulley 9, a pair of pivotable members 19A and 19B are pivotably supported by a pair of shafts 20A and 20B, respectively, at mutually symmetrical positions with respect to the supporting shaft 17. A connecting rod 21 interconnects the swingable members 19A and 19B in such a manner that, during operation, these members 19A and 19B are displaced by equal amounts.

A control switch 22 for giving an opening command to the switch 6 is mounted on the frame unit 16, and the control switch 22 has a switch lever 22L projecting therefrom, the switch lever 22L being capable of contacting the swingable member 19A or 19B when the swingable members have been displaced by a predetermined dimension. A catch weight 23 is supported by a lower portion of the frame unit 16 in such a manner as to be pivotably about a shaft 24. The catch weight 23 is disposed facing a holding portion 16H of the frame unit 16 with a gap between the catch weight 23 and the holding portion 16H. The governor rope 8 is passed through the gap.

The catch weight 23 has an engagement pin 23P. Normally, the engagement pin 23P is kept in engagement with a hook 25H at a first end of a holding piece 25 so that the catch weight 23 is held at a position at which the catch weight 23 does not catch the governor rope 8. The holding piece 25 is pivotably supported by the frame unit 16 and has a second end portion which is so positioned as to be capable of contacting the pivotable members 19A or 19B when the pivotable members have been displaced by a predetermined dimension. The position of the second end portion of the holding piece 25 is arranged such that the pivotable members 19A and 19B can contact the second end portion after contacting the switch lever 22L.

Figure 4:
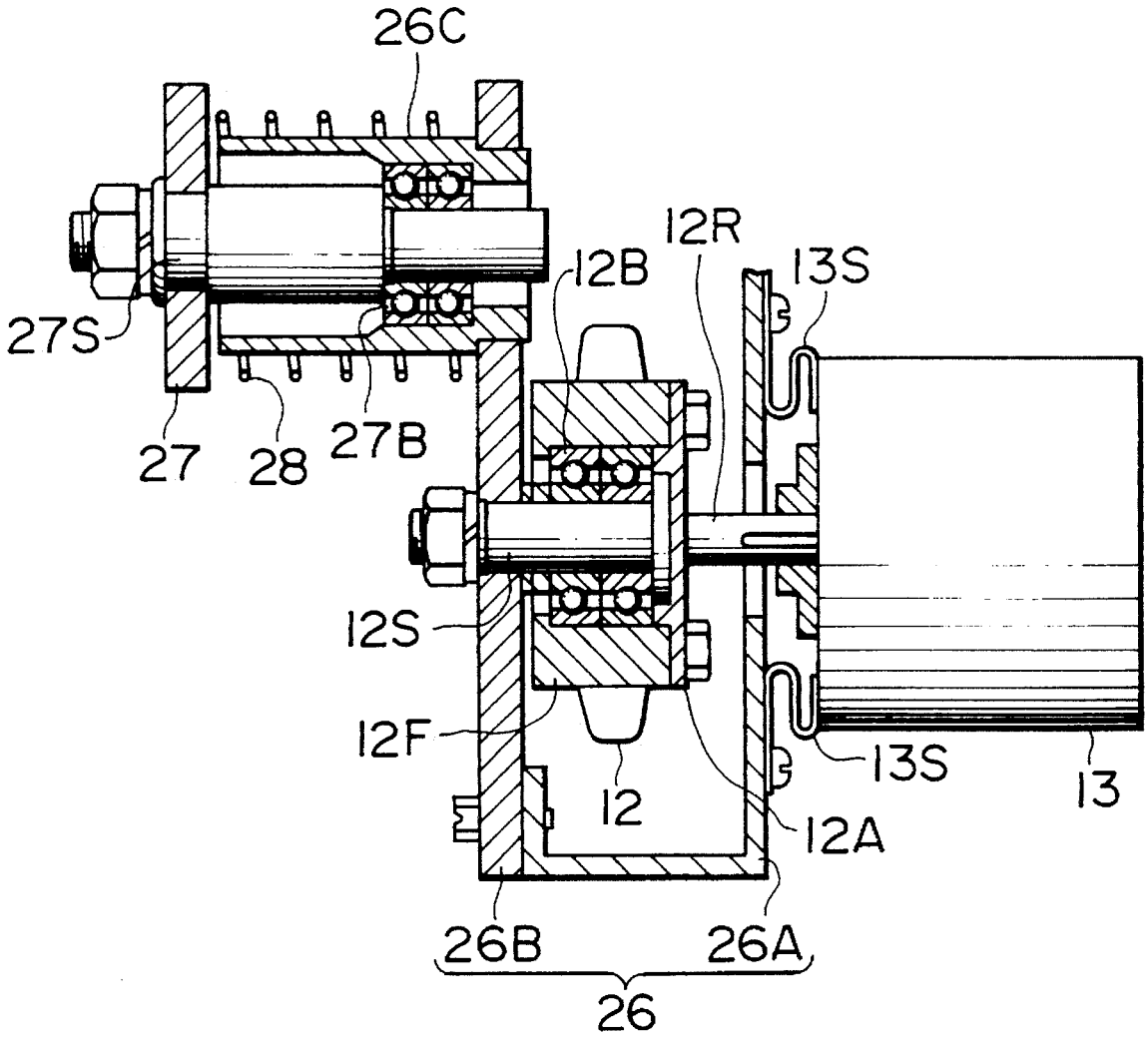
FIG. 4 is a plan sectional view showing a specific example of a structure for mounting a position detector shown in FIG. 3.

The position detector 13 is mounted to the frame unit 16. Referring to FIGS. 3 and 4, the position detector 13 is supported by a supporting unit 26 with an elastic member 13S, such as a plate spring, disposed between the position detector 13 and a first side wall 26A of the supporting unit 26. The supporting unit 26 has a second side wall 26B opposing the side wall 26A. The roller 12 is mounted to the second side wall 26B in such a manner as to be rotatable about a shaft 12S. As shown in FIG. 4, the roller 12 is fixed to the outer peripheral surface of an inner, hollow cylindrical support 12F with a roller bearing 12B disposed between the cylindrical support 12F and the shaft 12S. A connecting member 12R has a mounting portion 12A fixed to a first end face of the cylindrical support 12F and is connected to a rotary member (not shown) of the position detector 13 for transmitting power. Specifically, the connecting member 12R and the rotary member of the position detector 13 are interconnected in such a manner that these members are mutually engaged for movement in the direction of rotation of the roller 12 and that the members are slidable independently of each other, and hence displaceable relative to each other, in the direction of the axis of rotation of the roller 12. The supporting unit 26 is fixed to the frame unit 16 by a mounting frame 27, to which the supporting unit 26 is mounted in the following manner: The second side wall 26B of the supporting unit 26 is fixed to a first end portion of a hollow cylinder 26C, in which a supporting shaft 27S is relatively rotatably supported through a roller bearing 27B, with the mounting frame 27 being fixed to the supporting shaft 27S. An extension spring 28, such as a coil spring, is disposed on the outer periphery of the cylinder 26C with one end of the spring 28 engaging with the mounting frame 27 and the other end engaging with the supporting unit 26 so that the roller 12 presses against the roller rolling surface 11 with an adequate pressing force.

With the elevator apparatus having the above construction, when the switch 6 is closed and the power inverter 7 supplies controlled power to the induction motor 5, the drive sheave 1 is rotated so that the main rope 2 wound on the sheave 1 moves in accordance with the direction and amount of rotation of the drive sheave 1, causing the car 3 to move vertically. The vertical movement of the car 3 causes the governor rope 8, connected to the car 3 through the operating lever 3L, to move in the same direction as the car 3, so that the governor pulley 9 is rotated accordingly. The power of rotation of the governor pulley 9 is transmitted through the roller 12 to drive the position detector 13. The position detector 13 generates pulses, the number of which is counted to detect the current position of the car.

The rotary member of the position detector 13 is rotated by the roller 12 contacting an outer peripheral portion of the governor pulley 9. Since the roller 12 has a diameter smaller than that of the roller rolling surface 11, the roller 12 rotates at a higher speed. As a result, the position detector 13 undergoes high-speed rotation so as to generate an increased number of pulses, thereby enabling detection with increased precision.

The position detector 13 may have various constructions for generating pulses. For example, the position detector 13 may be of a type in which a multiplicity of slits are formed in a rotary disk, and pulses are generated by causing light to be passed through and blocked by the slits and intervals therebetween, respectively. In another type, a multiplicity of magnetic poles are formed on the outer periphery of a rotary member, and pulses are generated in accordance with the presence and absence of the magnetic poles. In either case, the greater the number of generated pulses, the more accurate the detection of position. In order to increase the number of generated pulses, the number of slits or magnetic poles may be increased. However, slits or magnetic poles cannot be provided beyond a limit determined by the size of an available space. In another method, the rotary member may be formed with a greater diameter so as to form a greater number of slits or magnetic poles. However, since increasing the diameter of the rotary member may involve a greater risk of deforming the rotary member, and require higher working techniques, this method may not be effective. According to the present invention, the number of revolutions per unit time in the position detector 13 is increased, thereby increasing the number of generated pulses.

Since the governor pulley 9 is rotated by the governor rope 8 driven by the car 3, there is no factor between the governor pulley 9 and the governor rope 8 that may cause rope slip which may occur between the drive sheave and the main rope connected to loads (a car and a counterweight). Furthermore, since no substantial load is suspended from the governor pulley 9, there is no risk of wire-lubricating oil bleeding from the governor rope 8. Thus, there is no risk of detection errors being caused by slipping of the roller 12 or adhesion of oil.

Since the connection between the roller 12 and the position detector 13 is such that only the movement of the rotary member of the position detector 13 in the direction of rotation of the roller 12 is restricted by the connecting member 12R of the roller 12, and such that movement of the rotary member in other directions is not restricted by the connecting member 12R, alignment between the roller 12 and the position detector 13 can be easily performed by utilizing the feature that the rotary position of the position detector 13 changes following changes in the rotary position of the connecting member 12R. Since the construction for transmitting power from the roller rolling surface 11 to the roller 12 is one merely utilizing contact, no precise alignment is necessary except that the parallelism of the relevant axes of rotation has to be checked carefully.

In the above-described embodiment, high-speed rotation is achieved in the position detector 13 by an arrangement in which the roller 12 of a diameter smaller than that of the governor pulley 9 is kept in contact with an outer peripheral portion of the governor pulley 9. However, where it is impossible to provide the roller 12 in contact with an outer peripheral portion of the governor pulley 9, another arrangement shown in FIG. 5 may be adopted to achieve high-speed rotation in the position detector 13.

Figure 5:
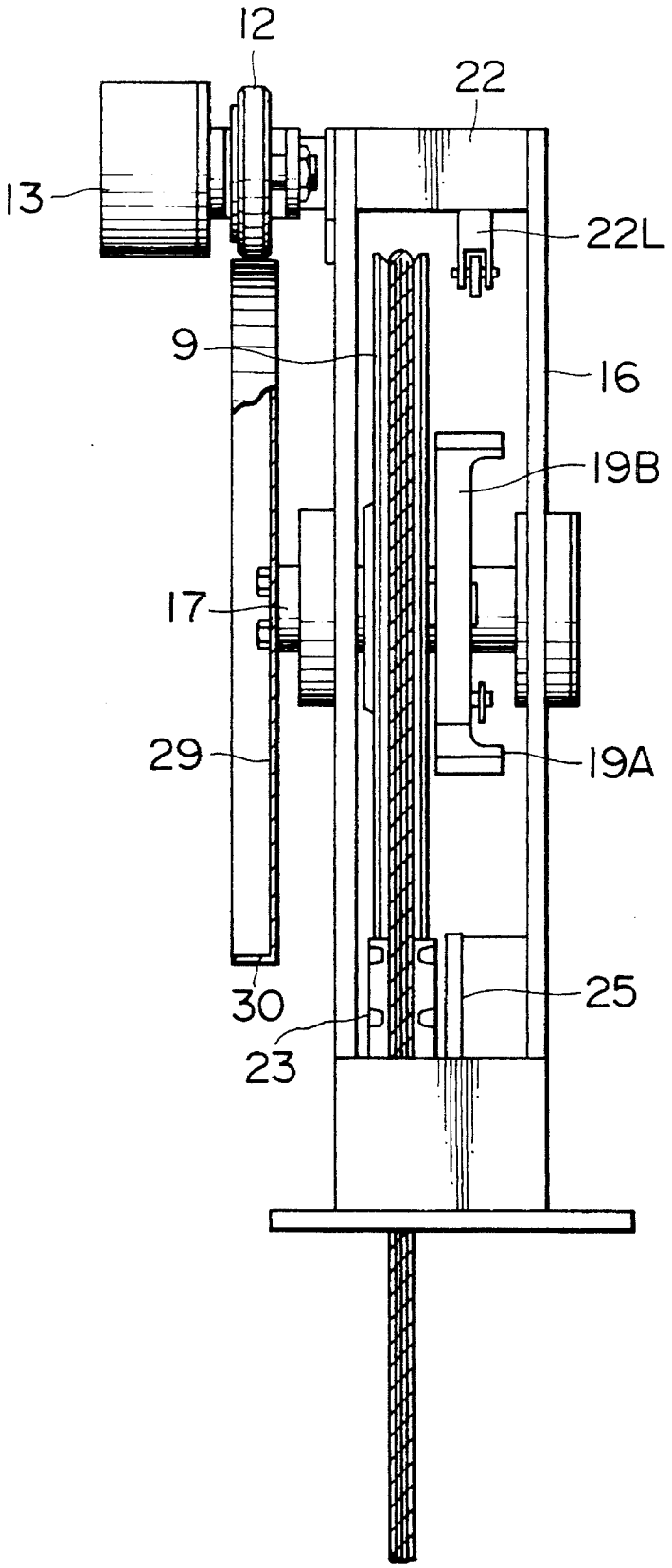
FIG. 5 is a side view schematically showing another embodiment of a governor of an elevator apparatus according to the present invention.

Referring to FIG. 5, the second embodiment has the following construction which is the same as the corresponding construction of the first embodiment: a governor pulley 9 is supported by a frame unit 16 in such a manner as to be rotatable about a supporting shaft 17. The frame unit 16 also supports a switch 22 having a switch lever 22L, a catch weight 23 and a supporting piece 25. The governor pulley 9 supports pivotable members 19A and 19B through the respective shafts.

In the second embodiment, the free end portion of the supporting shaft 17 projects outwardly from the frame unit 16, and a rotary disk member 29 is mounted to the projecting end. The rotary disk member has a roller rolling surface 30 formed on the outer periphery thereof, and the roller 12 for driving the position detector 13 is kept in contact with the roller rolling surface 13. In this embodiment, the position detector 13 is mounted to the frame unit 16 by the same structure as that in the first embodiment.

With the second embodiment, since the rolling surface 30 for the roller 12 is provided by the rotary disk member 29 mounted to the end of the supporting shaft 17, the position detector 13 can be easily incorporated without requiring special processing for forming the roller rolling surface on the governor pulley 9. Thus, the second embodiment is advantageous in that a commercially-available product can be readily used.

In the second embodiment, the position detector 13 is mounted on a governor having swingable members 19A and 19B supported on one side of the governor pulley 9. However, this is a mere example of the application of the present invention, and the present invention may be applied to another type of governor shown in FIG. 6.

Figure 6:
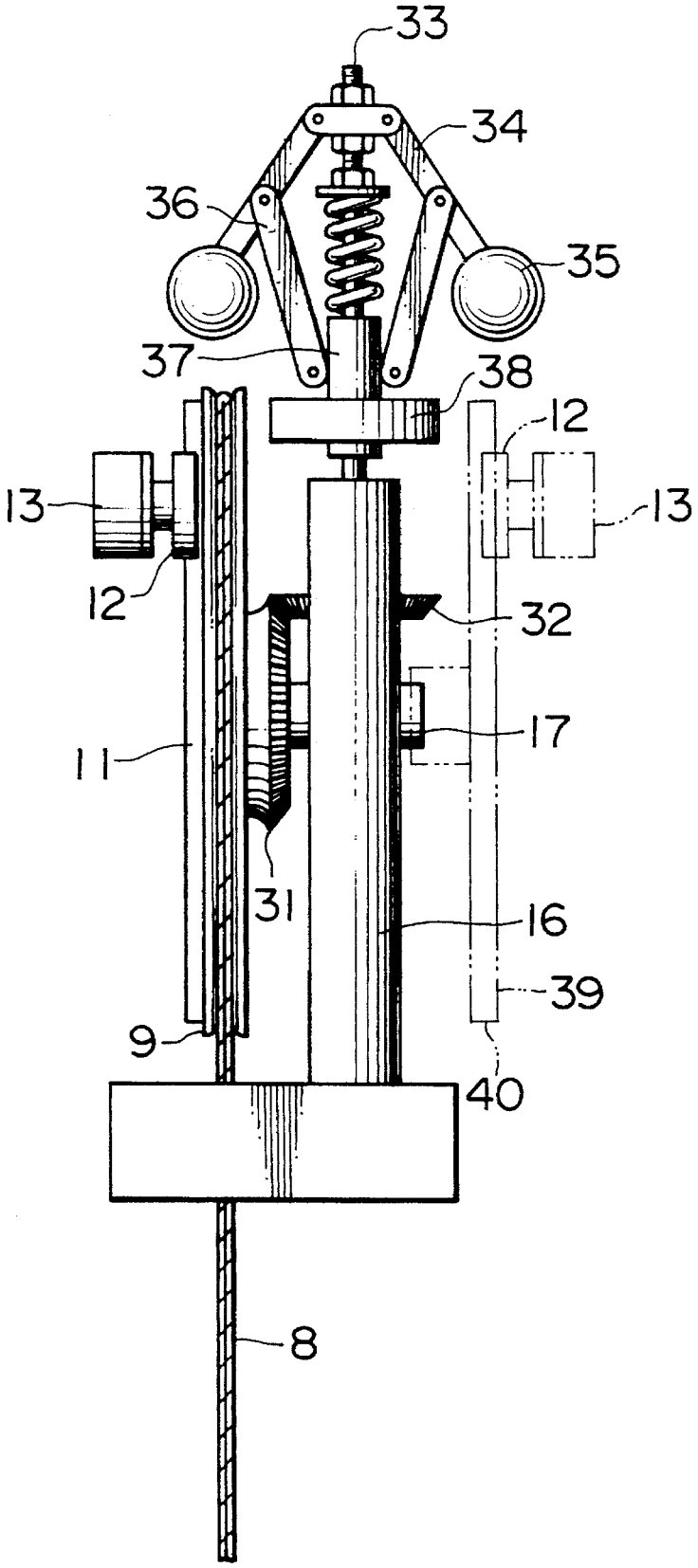
FIG. 6 is a side view schematically showing still another embodiment of a governor of an elevator apparatus according to the present invention.

Referring to FIG. 6, a first bevel gear 31 is provided on a governor pulley 9 supported by a frame unit 16 in such a manner as to be rotatable about a supporting shaft 17. A second bevel gear 32, meshing with the first bevel gear 31, is rotatably supported by the frame unit 16, with the axis of the second bevel gear 32 extending vertically. A vertical shaft 33 is connected to the second bevel gear 32 for rotation. Each of a pair of levers 34 has a first end pivotally supported by an upper portion of the vertical shaft 33, and a second end to which a weight 35 is mounted. A link 36 has an upper end pivotally mounted to an intermediate portion of a corresponding lever 34, and a lower end pivotally connected to a cylinder member 37 which is mounted on the vertical shaft 33 in such a manner as to be vertically movable thereon. A ring 38 is mounted on the cylinder member 37 in such a manner that the ring 38 follows only the vertically movement of the cylinder member 37. The ring 38 is arranged to actuate, through a link mechanism (not shown), a switch (not shown) and a catch weight (not shown) respectively corresponding to the switch 22 and the catch weight 23 shown in FIG. 2.

With the above construction, when the speed at which the car descends increases, the speed of rotation of the governor pulley 9, rotated by the governor rope 8 linked to the car 3, increases accordingly. Rotation of the pulley 9 at an increased speed causes the weights 35 to be displaced upward by centrifugal force, whereby the ring 38 is raised. As a result, the unillustrated switch and the catch weight are actuated through the link mechanism connected to the ring 38, so that the power source will be disconnected from the induction motor 5, and the governor rope 8 will assume its held position.

Also in the governor of the type shown in FIG. 6, a roller rolling surface 11 is formed on the governor pulley 9, and a roller 12 is kept in contact with the rolling surface 11 for rolling thereon, so that high-speed rotation is achieved in a position detector 13. In this construction, if it is not possible to form the roller rolling surface 11 on the governor pulley 9, a rotary disk member 39 with a roller rolling surface 40 formed on the outer periphery thereof may be mounted to the supporting shaft 17, as indicated by two-dot-chain lines in FIG. 6, so as to achieve high-speed rotation in the position detector 13 by virtue of the roller 12.

In each of the foregoing embodiments, the position of a car is detected by utilizing a governor. However, position detection may be performed by adopting an arrangement shown in FIG. 7.

Figure 7:
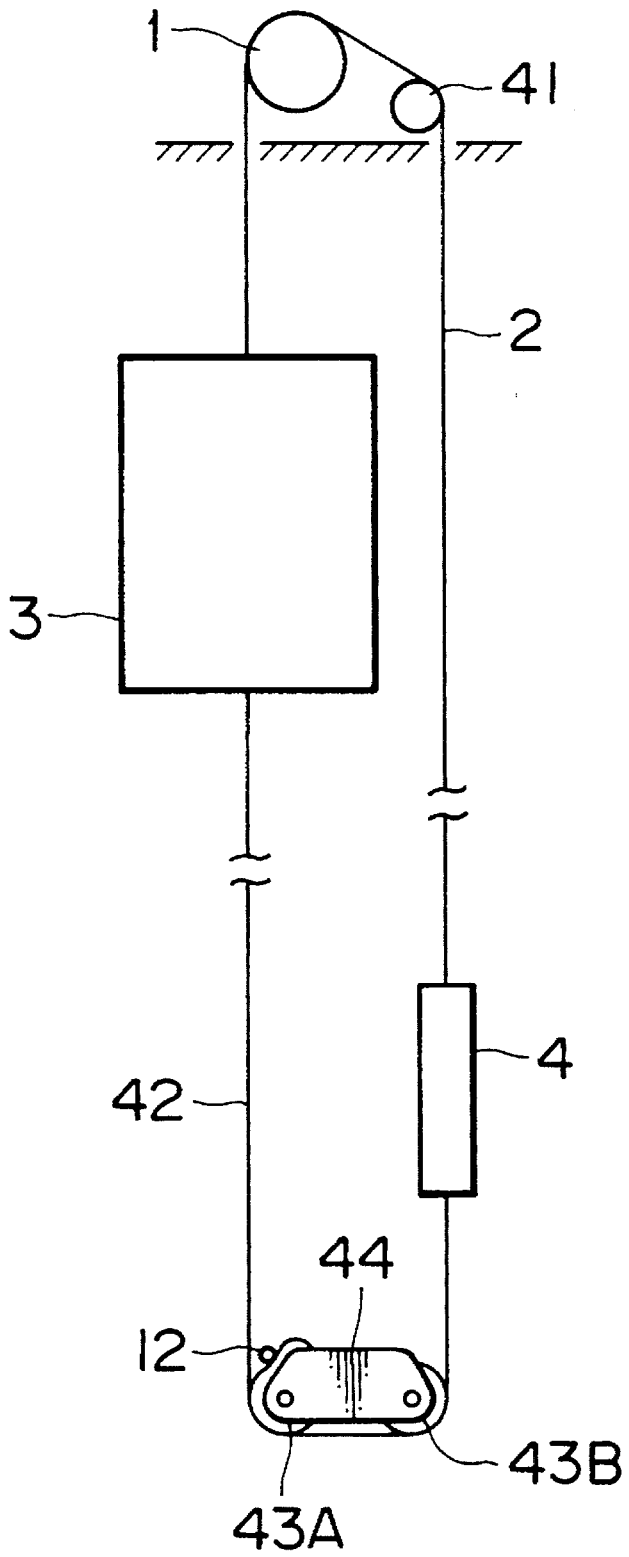
FIG. 7 is a side view schematically showing another embodiment of an elevator apparatus according to the present invention.

Referring to FIG. 7, in general, in an elevator apparatus, a main rope 2 is wound on both a drive sheave 1 and an idler sheave 41, and a car 3 and a counterweight 4 are suspended on either ends of the main rope 2. A balance rope 42, belonging to a system different from the drive system of the apparatus, is suspended interconnecting the respective bottom portions of the car 3 and the counterweight 4 so as to reduce unbalance in weight which may be caused by changes in the position of the car 3. Lower curved portions of the balance rope 42 are wound on a pair of tension pulleys 43A and 43B, each rotatably supported by a supporting frame 44, so as to prevent the balance rope 42 from having a loose or entangled portion. A roller 12, connected with a position detector (not shown), is kept in contact with one of the tension pulleys 43A and 43B, for example, with the tension pulley 43A, and is supported by the supporting frame 44. The roller 12, of course, has a diameter smaller than that of the tension pulley 43A.

The above arrangement also makes it possible to increase the rotational speed of the tension pulley 43A and to transmit rotation at a higher speed, thereby enabling the position of the car 3 to be detected with increased precision.

Alternatively, the following arrangement may be adopted: another rope driven by vertical movement of the car 3 is provided separately from the main rope 2, a governor rope 8 and the balance rope 42, and this car-driven rope is wound on a rotary member. A small-diameter roller is kept in contact with the rotary member so as to drive the position detector with an increased number of revolutions per unit time in the position detector.

In each of the foregoing embodiments, a roller is kept in contact with a rotary member so as to drive a position detector with a higher number of revolutions per unit time. Alternatively, the position detector may be driven at a higher number of revolutions per unit time by utilizing meshing gears. In this case, however, since looseness due to meshing errors may cause unwanted variations in the number of pulses generated, it is necessary to increase the precision at which gears are worked and/or to select materials capable of preventing looseness, so as to minimize the risk of looseness.

Figure 8:
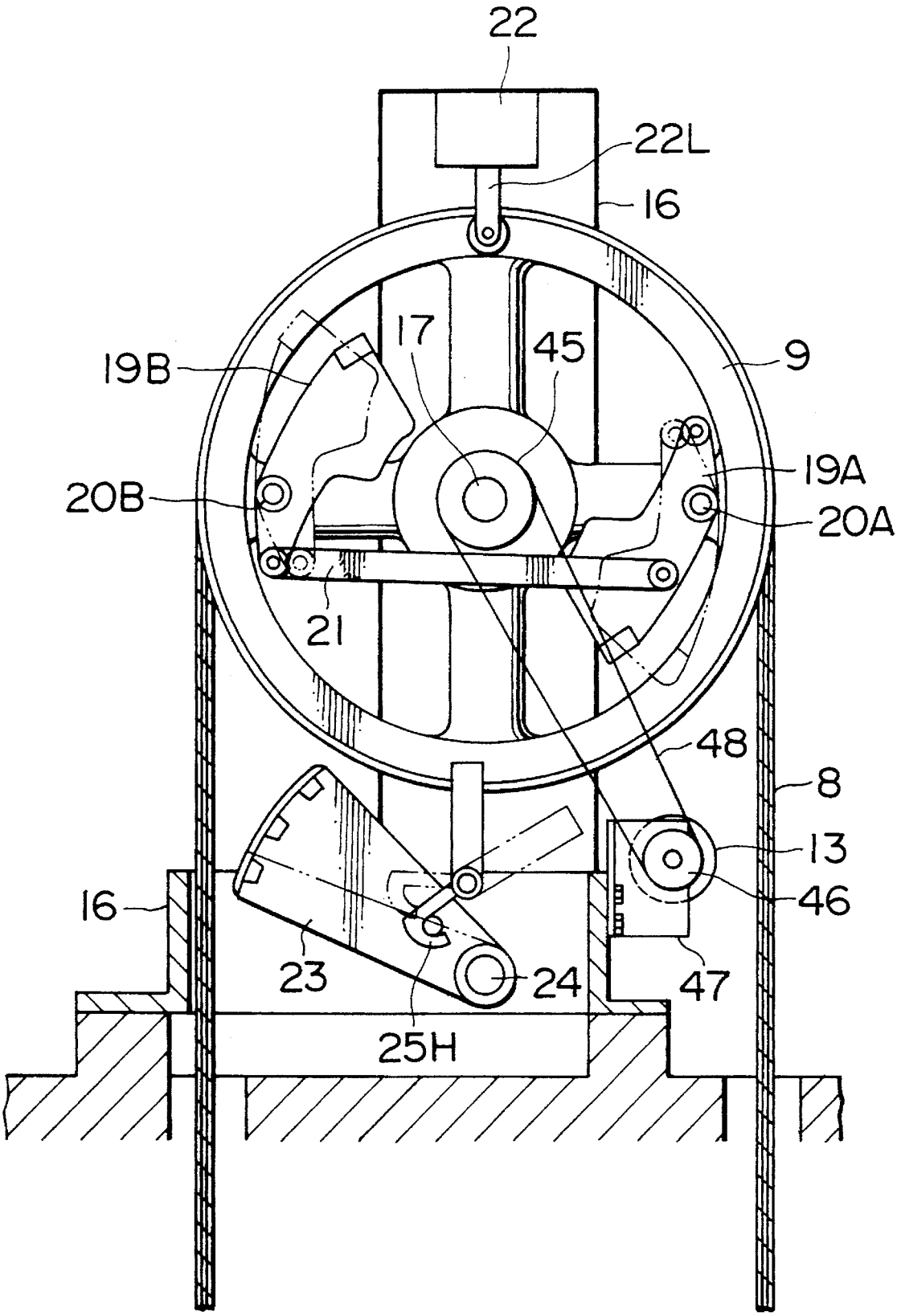
FIG. 8 is a side view schematically showing a further embodiment of a governor of an elevator apparatus according to the present invention

In another embodiment shown in FIG. 8, instead of driving the position detector with a higher number of revolutions per unit time by using a roller contacting a rotary member, the position detector is driven with a higher number of revolutions per unit time by using an endless member such as a belt or chain. In FIG. 8, component parts denoted by the same reference numerals as those shown in FIG. 2 have the same operations, and these component parts will not be described to avoid redundancy. In this embodiment, a first pulley 45 is fixed to the supporting shaft 17 to be rotatable in unison with the governor pulley 9. A second pulley 46, paired with the first pulley 45, and having a smaller diameter than the first pulley 45, is fixed to the frame unit 16 through a supporting member 47. A belt 48 is wound on both pulleys 45 and 46. A position detector 13, coaxial with the second pulley 46 and rotatable about its own axis, is supported by the supporting member 47.

With the above construction, rotation of the governor pulley 9 is transmitted through the first pulley 45, which is coaxial with the governor pulley 9, and through the belt 48 to the small-diameter second pulley 46, which is thus rotated at a higher speed. As a result, high-speed rotation is caused in the position detector 13, thereby enabling a higher number of pulses to be generated, and enabling detection to be performed with increased precision.

In order to prevent the belt 48 from undergoing slip between the paired pulleys 45 and 46, these members preferably comprise the types known as V belts and V-groove pulleys that have trapezoidal cross-sectional configurations. Further, in order to prevent slip from being caused between the pulleys 45 and 46 by stretching of the belt 48 after a long period of use, it is preferable to provide a device for imparting tension in such a manner that the tension of the belt 48 will be substantially constant over a long period of time, or to form the belt 48 using an elastic material having a core made of metal thin wires, synthetic fiber or the like so that the belt 48 will be stretched only slightly over a long period of time.

In an elevator apparatus in which a car moves vertically at relatively high speed, it is required to detect the position of the car with higher precision. If such is the case, the belt 48 may comprise a toothed belt while the pulleys 45 and 46 comprise toothed pulleys, so that rotation of the first pulley 45 can be positively transmitted to the second pulley 46.

Figure 9:
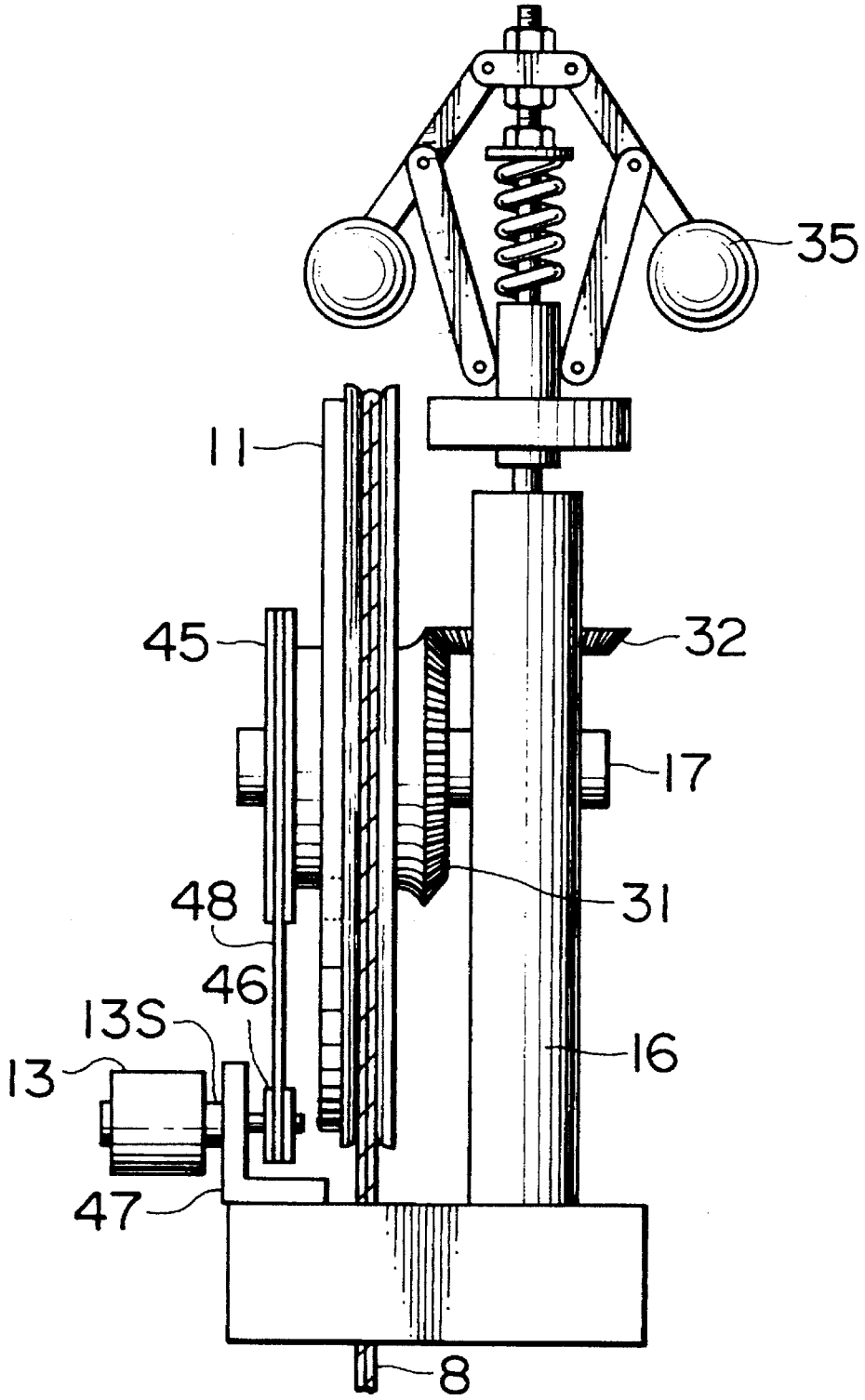
FIG. 9 is a side view schematically showing a still further embodiment of a governor of an elevator apparatus according to the present invention.

In another construction shown in FIG. 9, a governor of the type constructed as shown in FIG. 6 is arranged to have a power transmission mechanism including an endless member. In FIG. 9, component parts denoted by the same reference numerals as those shown in FIGS. 6 and 8 have the same operations, and these component parts will not be described to avoid redundancy.

Figure 10:
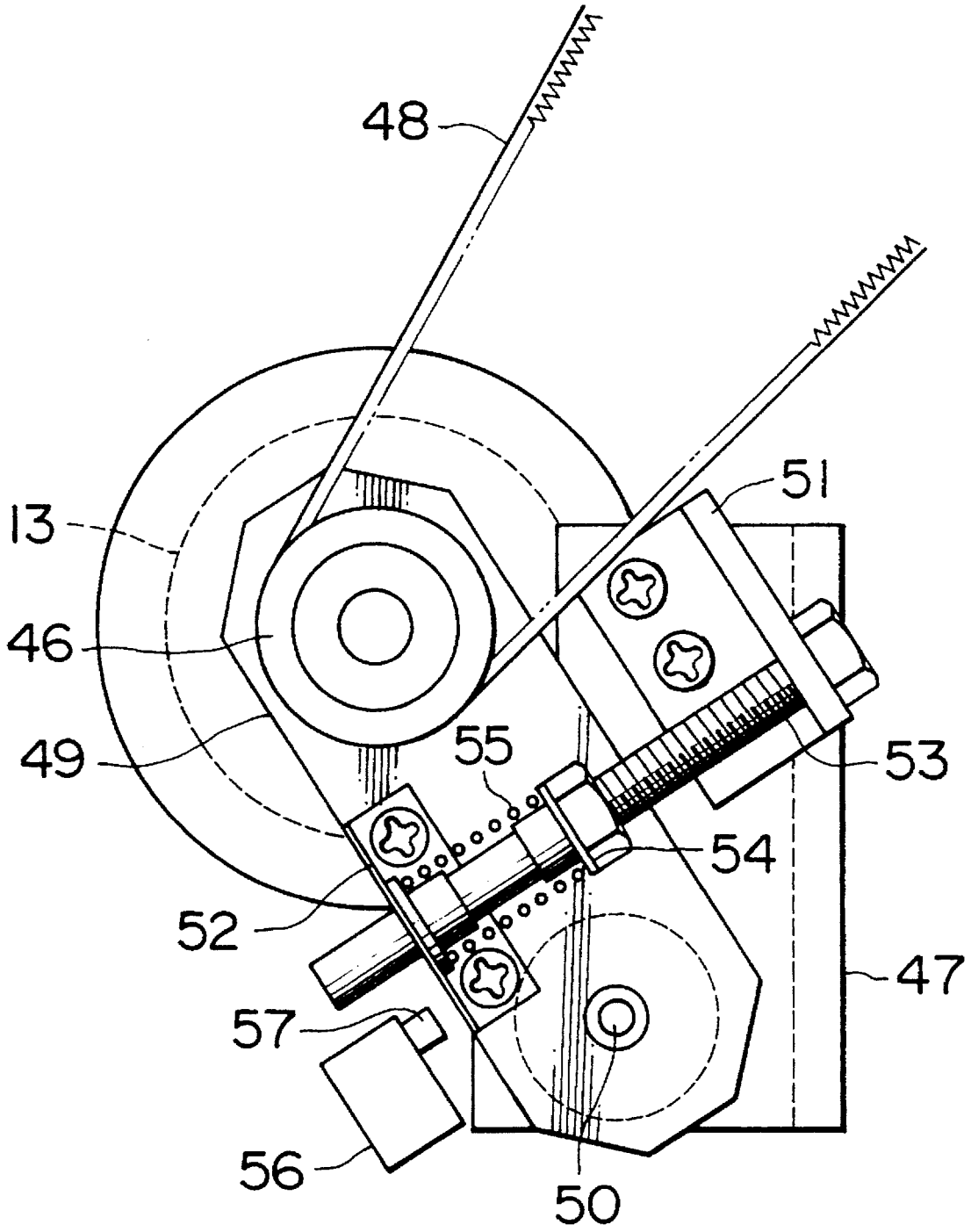
FIG. 10 is a side view schematically showing another example of a structure for mounting a position detector shown in FIG. 8 or FIG. 9.

In a structure shown in FIG. 10, the position of the second pulley 46 is rendered variable. The second pulley 46 is rotatably supported on a first end portion of a lever 49 having a second end supported by the supporting member 47 in such a manner as to be rotatable about a shaft 50. The position detector 13 is supported in the same manner. A first seat 51 is provided on the supporting member 47, while a second seat 52 opposing the first seat 51 is provided on the lever 49. A first end portion of a rod 53 is fixed to the first seat 51, with a second end portion of the rod 53 passing through the second seat 52 with a suitable play. A third seat 54 opposing the second seat 52 is provided on the rod 53, and a compression spring 55 is disposed on a portion of the rod 53 which is between the second and third seats 52 and 54. The compression spring 55 needs to be disposed in such a manner that the compression force of the spring 55 acts in a direction in which tension is imparted to the belt 48. An abnormality detection switch 56 is provided with its contact member 57 disposed in spaced opposition to that side of the second seat 52 remote from the compression spring 55.

With the above arrangement, since a certain tensile force always acts on the belt 48, even when the belt 48 becomes stretched after a long period of use, no slip occurs between the paired pulleys, and it is possible to effect stable transmission of torque. When the belt 48 has been cut, the force of the compression spring 55 causes the lever 49 to rotate about the shaft 50 in the counterclockwise direction and press against the contact member 57. As a result, the abnormality detection switch 56 is actuated so that the fact that position detection has become impossible is posted or displayed for stopping the operation of the elevator apparatus.

As has been described above, according to the present invention, an elevator apparatus has an easily mountable position detector, and is capable of detecting the position of a car with high precision.

What is claimed is:

1. An elevator apparatus comprising:

a governor adapted to be driven by a cable connected to an emergency stop device mounted on an elevator car and capable of actuating the emergency stop device when the speed of the car exceeds a prescribed speed;

a position detector; and a power transmission mechanism responsive to rotation of said governor, for causing rotation of said position detector at a speed higher than the speed of rotation of said governor.

2. An elevator apparatus comprising:

a rotary member adapted to be driven by a cable which is independent of a drive system connected to an elevator car of said elevator apparatus;

rotational transfer means driven by said rotary member; and a position detector driven by said rotational transfer means at a speed higher than the speed of said rotary member.

3. An elevator apparatus according to claim 2, wherein said rotary member is provided at a fixed position.

4. An elevator apparatus according to claim 3, wherein said fixed position comprises the interior of a machine house at an uppermost location of an elevator shaft in which said car is vertically moved.

5. An elevator apparatus according to claim 2, wherein the cable is a governor cable which is driven by the elevator car.

6. An elevator apparatus comprising:

a rotary member adapted to be driven be a cable which is independent of a drive system connected to an elevator car of said elevator apparatus, said rotary member being provided at a fixed position;

a position detector; and rotational transfer means responsive to rotation of said rotary member for driving said position detector at a speed higher than the speed of said rotary member.

7. An elevator apparatus according to claim 6, wherein the cable is a governor cable which is driven by the elevator car.

8. An elevator apparatus comprising:

an endless rope which is independent of a drive system connected to an elevator car of said elevator apparatus;

a rotary member driven by said rope;

a position detector; and rotational transfer means for causing rotation of said position detector at a speed higher than the speed of rotation of said rotary member.

9. An elevator apparatus according to claim 8, wherein the rope is a governor cable which is driven by the elevator car.

10. An elevator apparatus including:

a governor pulley adapted to be driven by a cable which is independent of a drive system connected to an elevator car of said elevator apparatus; and a position detecting means driven from an outer peripheral portion of said governor pulley.

11. An elevator apparatus according to claim 10, wherein said position detecting means frictionally engages said governor pulley to be driven thereby.

12. An elevator apparatus according to claim 10, wherein said position detecting means is in meshing engagement with said governor pulley to be driven thereby.

13. An elevator apparatus according to claim 10, wherein the cable is a governor cable which is driven by the elevator car.

14. An elevator apparatus comprising:

an emergency stop device mounted on an elevator car and having an operating lever;

a governor having an endless governor rope connected to said operating lever of said emergency stop device, and a governor pulley having a rope groove and a roller rolling surface concentrically formed thereon and driven by said governor rope in said rope groove of said governor pulley, said governor responsive to detecting of excessive speed of the elevator car from the rotation of said governor pulley for actuating said emergency stop device;

a position detector driven by said governor; and a roller having a diameter smaller than the diameter of said roller rolling surface, said roller contacting said roller rolling surface, said roller driving said position detector, and said roller rolling surface having a radius extending outwardly to a point coinciding with the axis of said governor rope.

15. An elevator apparatus comprising:

a governor;

means which is independent of a drive system for said elevator apparatus for driving said governor;

a rotary member mounted on said governor and having a roller rolling surface formed thereon;

a roller contacting said roller rolling surface and having a diameter smaller than the diameter of said roller rolling surface, said roller being driven by said roller rolling surface at a speed higher than the speed of said rotary member; and a position detector driven by said roller.

16. An elevator apparatus according to claim 15, wherein said independent means is a governor cable which is driven by the elevator car.

17. An elevator apparatus comprising:

an induction motor adapted to be supplied with power from an alternating-current power source through a power inverter;

a drive sheave driven by said induction motor;

a main rope wound on said drive sheave;

an elevator car suspended by said main rope;

an emergency stop device mounted on said elevator car and having an operating lever;

a governor having an endless governor rope connected to said operating lever of said emergency stop device and having an intermediate portion extending in the same direction as said main rope, and a governor pulley with a rope groove and a roller rolling surface formed concentrically thereon and driven by said governor rope in said rope groove of said governor pulley, said governor responsive to detecting excessive speed of said elevator car from the rotation of said governor pulley for actuating said emergency stop device;

a roller having a diameter smaller than the diameter of said roller rolling surface, said roller contacting said roller rolling surface to be driven thereby;

a position detector driven by said roller; and a controller for controlling said power inverter on the basis of a position signal from said position detector.

18. A governor for an elevator apparatus, comprising:

a rotary governor member adapted to be driven by means which is independent of a drive system for an elevator car of said elevator apparatus; and means forming a measurement peripheral surface on said rotary governor member.

19. A governor for an elevator apparatus according to claim 18, wherein said rotary governor member comprises a governor rope, and a governor pulley having a rope groove for receipt of said governor rope.

20. A governor for an elevator apparatus according to claim 19, wherein said forming means forms said measurement peripheral surface adjacent to said rope groove.

21. A governor for an elevator apparatus according to claim 19, wherein said forming means forms said measurement peripheral surface with a radius extending outwardly to a point coinciding with the axis of said governor rope in said rope groove.

22. An elevator apparatus according to claim 18, wherein said independent means is a governor cable which is driven by the elevator car.

23. A governor for an elevator apparatus, comprising:

a governor pulley adapted to be driven by means which is independent of a drive system for an elevator car of said elevator apparatus;

a position detector; and rotary speed increasing means responsive to rotation of said governor pulley for causing rotation of said position detector at a speed higher than the speed of rotation of said governor pulley.

24. An elevator apparatus according to claim 23, wherein said independent means is a governor cable which is driven by the elevator car.

25. An elevator apparatus comprising:

a rotary member adapted to be driven by a cable which is independent of a drive system connected to an elevator car, said rotary member having a roller rolling surface formed thereon;

a roller having a diameter smaller than the diameter of said roller rolling surface, said roller contacting said roller rolling surface to be driven thereby; and a position detector connected with said roller for movement in the direction of rotation of said roller and displaceable relative to said roller in the direction of the axis of rotation of said roller.

26. An elevator apparatus according to claim 25, wherein the cable is a governor cable which is driven by the elevator car.

27. An elevator apparatus comprising:

a governor adapted to be driven by a cable connected to an emergency stop device mounted on an elevator car, said governor capable of actuating the emergency stop device when the speed of the elevator car exceeds a prescribed speed;

a position detector driven by said governor; and an endless member responsive to rotation of said governor for causing rotation of said position detector at a speed higher than the speed of said governor.

28. An elevator apparatus according to claim 27, wherein:

said governor includes a first pulley connected to be rotated in unison with said governor;

said elevator apparatus further comprises a second pulley of a diameter smaller than the diameter of said first pulley and connected to drive said position detector; and said endless member has a first end wound on said first pulley and a second end wound on said second pulley.

29. An elevator apparatus according to claim 28, further comprising means elastically supporting said second pulley in such a manner as to be displaceable in a direction in which the distance between said first and second pulleys increases.

30. An elevator apparatus comprising:

a governor adapted to be driven by a cable connected to an emergency stop device mounted on an elevator car, said governor capable of actuating the emergency stop device when the speed of the elevator car exceeds a prescribed speed;

a position detector driven by said governor;

an endless member responsive to rotation of said governor for causing rotation of said position detector at a speed higher than the speed of said governor;

means for imparting tension to said endless member; and means for detecting a cut state of said endless member.

31. An elevator apparatus comprising:

an emergency stop device adapted to be mounted on an elevator car and having an operating lever;

a governor having an endless governor rope connected to said operating lever of said emergency stop device to be driven by vertical movement of the elevator car, and a governor pulley driven by said governor rope, said governor being responsive to the rotational speed of said governor pulley exceeding a speed corresponding to a prescribed speed of the elevator car for actuating said emergency stop device so as to effect an emergency stop of the elevator car;

a position detector;

a first toothed pulley mounted to be rotatable in unison with said governor pulley;

a second toothed pulley mounted to rotate said position detector and having a diameter smaller than the diameter of said first toothed pulley;

means for varying the distance between said first and second toothed pulleys;

a toothed belt wound on said first and second toothed pulleys;

an elastic member urging said second toothed pulley in a direction in which said second toothed pulley imparts tension to said belt; and an abnormally detection switch for detecting an abnormal state of said belt by detecting displacement of said second toothed pulley.

* * * * *